US006678573B2

(12) United States Patent
Tamai

(10) Patent No.: US 6,678,573 B2
(45) Date of Patent: Jan. 13, 2004

(54) SEWING MACHINE WITH HIGH SPEED INTERFACE FOR PERSONAL COMPUTER CONTROL

(76) Inventor: Hirofumi Tamai, 29-5, Shinsenri Minami-machi 3-chome, Toyonaka-shi, Osaka-Fu (JP)

( * ) Notice: Subject to any disclaimer, the term of this patent is extended or adjusted under 35 U.S.C. 154(b) by 0 days.

(21) Appl. No.: 10/223,689

(22) Filed: Aug. 20, 2002

(65) Prior Publication Data

US 2003/0056702 A1 Mar. 27, 2003

(30) Foreign Application Priority Data

Aug. 20, 2001 (CA) ..... 2355513
Aug. 20, 2001 (CA) ..... 2355540

(51) Int. Cl.[7] ..... G06F 19/00; D05B 19/00
(52) U.S. Cl. ..... 700/136; 112/470.01
(58) Field of Search ..... 700/136, 137, 700/138, 130; 112/102.5, 470.06, 470.01, 275, 277

(56) References Cited

U.S. PATENT DOCUMENTS 5,359,949 A * 11/1994 Asano ..... 112/102.5 X
5,831,858 A 11/1998 Wakayama
5,970,894 A * 10/1999 Mase ..... 112/102.5
5,988,083 A 11/1999 Tomita et al.
6,119,611 A * 9/2000 Tomita ..... 112/470.04
6,135,038 A * 10/2000 Okamoto ..... 112/102.5
6,216,618 B1 * 4/2001 Goldberg et al. ..... 112/470.04
6,445,970 B1 * 9/2002 Hedman et al. ..... 700/138

OTHER PUBLICATIONS

Jones, Deborah, *Not Your Mother's Sewing Machine*, EMB, Jun. 2001, pp. 50–53.

* cited by examiner

*Primary Examiner*—Peter Nerbun

(57) ABSTRACT

A sewing machine comprising one or more motion means to effect a sewing function, each motion means having a dedicated motion control processor responsive to sewing commands addressed to said motion control processor, for controlling said motion means to effect said sewing faction; and a high speed communications interface for exchanging information between each said motion control processor and an external computer, whereby said sewing commands are determined by the external computer.

25 Claims, 2 Drawing Sheets

SEWING MACHINE WITH HIGH SPEED INTERFACE FOR PERSONAL COMPUTER CONTROL

This application claims priority from Canadian Patent Application Nos. 2,355,513 and 2,355,540, both filed on Aug. 20, 2001, and incorporated herein by reference.

The invention relates to the field of automated sewing machines, and more specifically to automated sewing machines that are controlled by external computers over high speed networks.

BACKGROUND OF THE INVENTION

It is assumed in the following description that sewing includes all forms of thread manipulation, such as embroidering, button holing and the like.

Existing automated sewing machines for commercial and industrial use may be classified into two main categories. The first category includes automated machines that have an integrated control panel and a dedicated on-board computer, that reads design files describing a sewing or embroidery pattern from a floppy drive, that allow for limited manipulation of the design, and that control machine operations to produce the design. The second category includes automated sewing machines that typically have a RS-232 communications port for the purpose of receiving design data or files from an external computer. Being stored temporarily, the files are then interpreted and sewn by the machine.

A disadvantage of both of these categories of machines is that they rely on slow interfaces that are coupled to an on-board computer that reads design files, interprets the files, and then operates the machine. The use of slow interfaces such as RS-232 limits machine networking capabilities and operational flexibility. Moreover, the dedicated nature of the on-board computer represents a barrier to creating low cost, automated machines.

Recent domestic sewing and embroidery machine models sold to consumers for household use may allow for communication of data files from a personal computer ("PC") via a serial connection. However, compared to traditional home sewing machines, these newer machines have proven to be quite expensive. These machines are limited in functionality and quality as machine designers have been forced to compromise their operational and mechanical specifications in order to achieve a lower target price. In these machines, the serial connection serves merely as a relatively slow means for transferring an entire or partial data file to the machine. That is, the serial connection is typically not adequate for providing real time control from an external host control system or to support networking. In addition to controlling machine operation, the dedicated on-board computer must perform the functions of reading a design file and interpreting it and responding to the minimal human machine interface ("HMI") that is typically resident on the machine's control panel.

There is thus a need to reduce the price limitations while improving the operational limitations of current sewing systems.

A still further need exists for a cost-effective automated sewing machine system that will allow for efficient networking and machine control.

SUMMARY OF THE INVENTION

In accordance with this invention, there is provided a sewing machine comprising:

(a) one or more motion means to effect a sewing function, each motion means having a dedicated motion control processor responsive to sewing commands addressed to said motion control processor, for controlling said motion means to effect said sewing function; and (b) a high speed communications interface for exchanging information between each said motion control processor and an external computer, whereby said sewing commands are determined by the external computer.

BRIEF DESCRIPTION OF THE DRAWINGS

Embodiments of the invention may best be understood by referring to the following description and accompanying drawings in which.

DETAILED DESCRIPTION OF THE PREFERRED EMBODIMENTS

In the following description, numerous specific details are set forth to provide a thorough understanding of the invention. However, it is understood that the invention may be practiced without these specific details. In other instances, well-known structures and/or processes have not been described or shown in detail in order not to obscure the invention. In the description and drawings, like numerals refer to like structures or and/or processes.

The invention provides an automated sewing machine system that includes a high-speed communications interface to an external network or computer for control of sewing machine functions. The high-speed communications interface may include Ethernet, USB, or IEEE1394 (e.g. Firewire™, i.Link™).

Advantageously, the invention allows control electronics to be located in a low cost PC system thereby allowing for the removal of expensive on-board, embedded or integrated control computers from sewing machines. This provides considerable cost savings and increased system operation flexibility.

Figure 1:
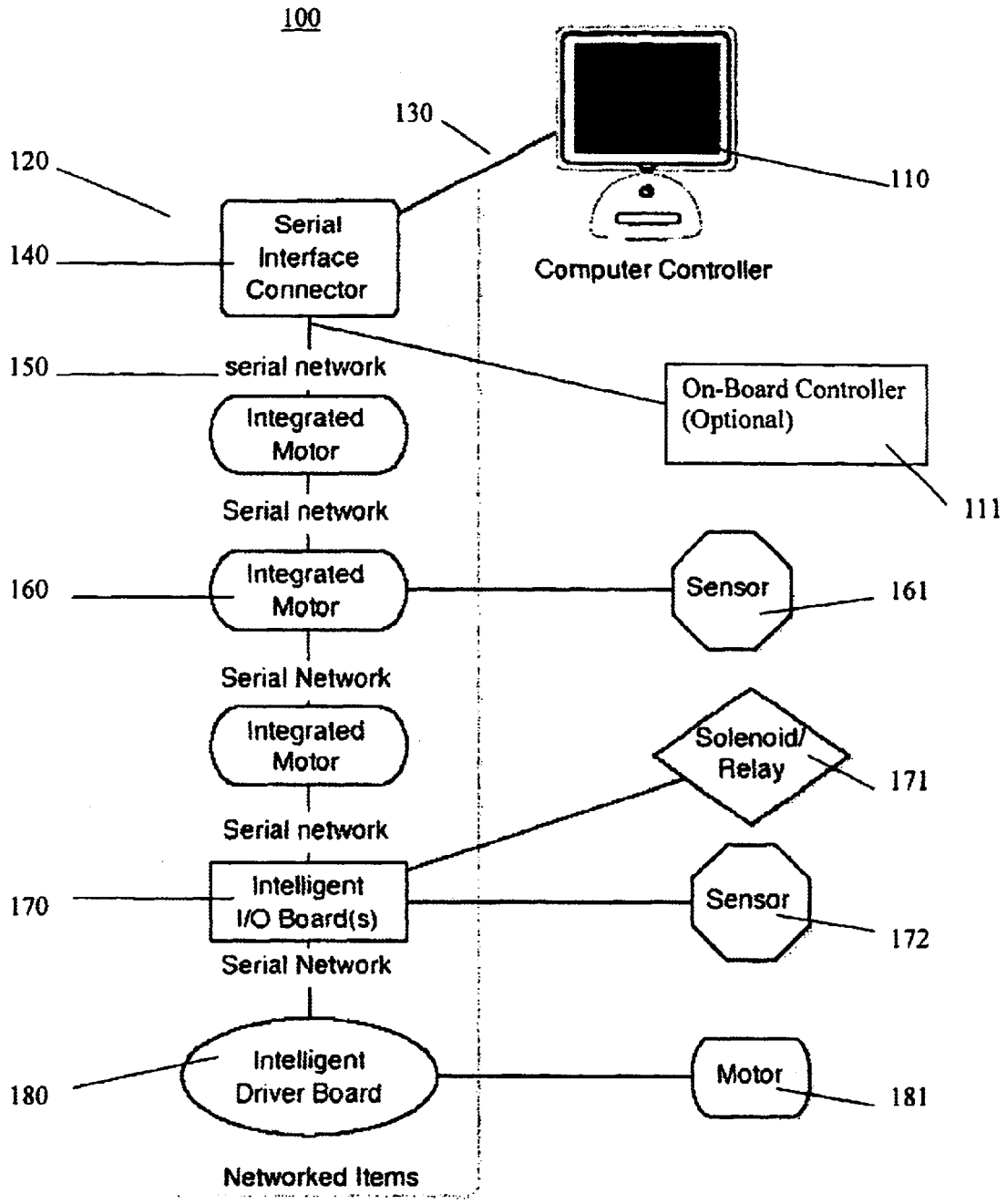
FIG. 1 is a block diagram illustrating an automated sewing machine system in accordance with an embodiment of the invention.

System. Referring to FIG. 1, there is shown a block diagram illustrating an automated sewing machine system 100 in accordance with an embodiment of the invention. The automated sewing machine system 100 includes an external computer 110, an automated sewing machine 120, and an interface cable 130 between the computer 110 and automated sewing machine 120.

The external computer 110 may include a central processing unit or CPU, memory, and a display. The input device may be a keyboard, mouse, trackball, or similar device. The CPU may include dedicated coprocessors and memory devices. The memory may include RAM, ROM, databases, or disk devices. And, the display may include a computer screen or terminal device.

The automated sewing machine 120 includes a serial interface connector 140, motion means such as integrated motors 160 with associated sensors 161, intelligent input/output ("I/O") boards 170 with associated solenoids/relays 171 and sensors 172, and motion control processors such as intelligent driver boards 180 for motors 181. The integrated motors 160, I/O boards 170, and intelligent driver boards 180 are connected to a serial network 150. The serial network 150 is connected to the external computer 110 through the serial interface connector 140 and interface cable 130. The automated sewing machine 120 or its internal electronics 160, 161, 170, 171, 172, 180, 181 may also include a central processing unit or CPU, memory, and a display. The input device may be a keyboard, mouse, trackball, or similar device. The CPU may include dedicated coprocessors and memory devices. The memory may include RAM, ROM, databases, or disk devices. And, the display may include a computer screen or terminal device.

The automated sewing machine system 100 has stored therein data representing sequences of instructions which when executed cause the method described herein to be performed. Of course, the sewing machine system 100 may contain additional software and hardware a description of which is not necessary for understanding the invention.

The automated sewing machine 120 includes electronics 160, 161, 170, 171, 172, 180, 181 necessary for machine control and a high speed connection 130, 140 in the form of an Ethernet interface, a USB interface, or an IEEE1394 interface. The automated sewing machine 120 and/or its internal electronics 160, 161, 170, 171, 172, 180, 181 includes software for receiving machine commands from an external source such as the external computer 120 via the high-speed connection 130, 140. The automated sewing machine 120 and/or its internal electronics 160, 161, 170, 171, 172, 180, 181 also includes software for sending machine control or status commands to an external computer 120, be it a host PC, a PDA, or another machine with an embedded CPU or host computer, via the high-speed connection 130, 140, 150.

The automated sewing machine system 100 operates as follows. Being connected to an external computer 110, the automated sewing machine's internal electronics 160, 161, 170, 171, 172, 180, 181 receive initialization and motion and sewing commands via the high-speed interface 130, 140, 150. The internal electronics 160, 161, 170, 171, 172, 180, 181 then execute machine operations based on the received commands while monitoring machine functioning, responding to alarms provided by safety systems (not shown), or sewing machine sensors 161, 172, and providing machine operation or status feedback to the external computer 110 via the high-speed interface 130, 140, 150.

The motion and sewing commands and parameters received by the internal electronics 160, 161, 170, 171, 172, 180, 181 contain all the information required by the automated sewing machine 120 to sew or cut a desired design. The machine's internal electronics 160, 161, 170, 171, 172, 180, 181 take the motion and sewing commands and parameters and generate the desired action. Sensors 161, 181 in the system feedback information to the external computer 120 concerning machine operation. This fedback information may be used to refine subsequent motion and sewing commands and parameters.

An advantage of the present invention is the high-speed interface 130, 140, 150 that is integrated with the automated sewing machine 120. As mentioned, this interface 130, 140, 150 may be an Ethernet interface, a USB interface, or an IEEE1394 interface. The interface 130, 140, 150 provides high-speed communications allowing for real-time or near real-time control and monitoring of the automated sewing machine 120 by an external computer, PDA or other machine 110. This allows the automated sewing machine 120 to be optimized to perform The functions of sewing, cutting, etc. the desired design as specified by the external computer 120.

Another advantage of the invention is that the high-speed serial network or bus 150 allows the automated sewing machine 120 to have distributed control functionality. For example, each motor 181 included in the machine 120 includes a controller 180 having a unique identification ("ID"), for responding only to commands received with that unique identification from the external computer 120. In this way, the motors 181 may be connected to a single bus 150 and respond only to commands having their unique ID while ignoring other commands. By using such distributed control functionality the cost of the automated sewing machine 120 is typically reduced while its flexibility is increased.

Figure 2:
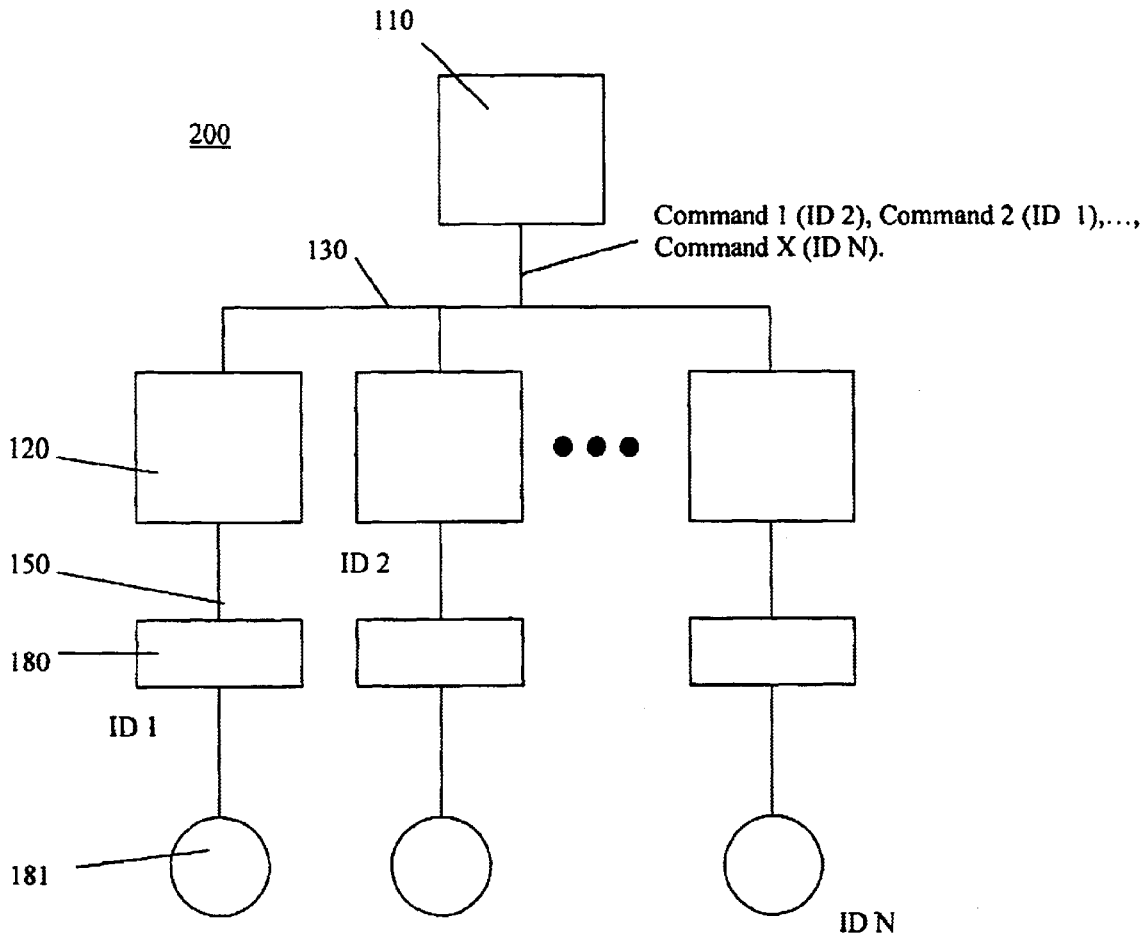
FIG. 2 is a schematic diagram showing a networked arrangement of sewing machines according to an embodiment of the present invention.

Referring to FIG. 2, there is shown a block diagram illustrating an automated sewing machine network 200 in accordance with an embodiment of the invention. The automated sewing machine network 200 includes an external computer 110 which is coupled to multiple automated sewing machines 120 via an interface cable network 130. Each automated sewing machine 120 includes internal electronics including intelligent driver boards or motion control processors 180 and motors 181. The external computer 110 connects to each machine's internal network 150 via a serial interface 140. Through the automated sewing machine network 200, 150, an external computer 110 can send commands (i.e. Command 1, Command 2, . . . , Command X) to addressed machines and/or machine components (e.g. ID 1, ID 2, . . . , ID N) on the network. The computer 110 can be separate from or attached to a given machine 120. All control commands and responses are transmitted along the serial network 150 within the machine 120. Intelligent devices such as motion control processors 180 may have one or more network interfaces that allow connection to the network backbone 150. The network 200, 150 may have a daisy chain, multi drop, or tree structure. This is an advantage over existing automate sewing machines that typically have a central controller within the machine that is connected to multiple motor drivers and I/O interfaces.

In an alternate embodiment, the automated sewing machine includes on-board controller 111 that is coupled between the serial interface connector 140 and serial network 150. This on-board controller acts as an intermediary between the external computer 110 and serial network 150 and it may include a central processing unit or CPU, memory, and a display. The input device may be a keyboard, mouse, trackball, or similar device. The CPU may include dedicated coprocessors and memory devices. The memory may include RAM, ROM, databases, or disk devices. And, the display may include a computer screen or terminal device.

With this alternate embodiment, the automated sewing machine's control, monitoring, and design manipulation electronics and software are again separated from the machine's internal electronics 160, 161, 170, 171, 172, 180, 181. The on-board controller 111 performs the function of command exchange with the external computer 110. The external computer 110 handles the function of interpreting the desired design and transforming it into motion commands. It also provides an interface for machine parameter adjustment and monitors machine sensors 161, 172, providing safety and user feedback functions.

Advantageously, this embodiment also provides an automated sewing machine 120 without an internal control system for interpreting design files and for generating and providing motion commands to the machine's internal electronics, with the exception of safety related mechanisms. By using an external control system or computer 110, the automated sewing machine 120 requires minimal electronics to execute motion and to sense operation. A dedicated, feature rich, user interface for the automated sewing machine 120 becomes unnecessary and this user interface may be provided using the external computer 110. The function of modifying designs based on direct user interaction is performed using the external computer. This reduces cost, complexity and size, allowing for advances in design and market penetration. The external control system or computer 110 may include an inexpensive, mass produced PC which will allow for diversity and flexibility through continued independent advances in software and hardware.

Data Carrier Product. The sequences of instructions which when executed cause the method described herein to be performed by the automated sewing machine system 100 of FIG. 1 can be contained in a data carrier product according to an embodiment of the invention. This computer software product can be loaded into and run by the automated sewing machine system 100 of FIG. 1.

Computer Software Product. The sequences of instructions which when executed cause the method described herein to be performed by the automated sewing machine system 100 of FIG. 1 can be contained in a computer software product according to an embodiment of the invention. This computer software product can be loaded into and run by the automated sewing machine system 100 of FIG. 1.

Integrated Circuit Product. The sequences of instructions which when executed cause the method described herein to be performed by the automated sewing machine system 100 of FIG. 1 can be contained in an integrated circuit product including a coprocessor or memory according to an embodiment of the invention. This integrated circuit product can be installed in the automated sewing machine system 100 of FIG. 1.

Although preferred embodiments of the invention have been described herein, it will be understood by those skilled in the art that variations may be made thereto without departing from the spirit of the invention or the scope of the appended claims.

What is claimed is:

1. A sewing machine comprising:

(a) one or more motors each having a dedicated controller responsive to sewing commands addressed to said controller for controlling each said motor to perform a predetermined sewing function; and, (b) a high speed network coupling each said controller and for delivering said sewing commands directly from an external computer, said sewing commands being determined by said external computer to perform said predetermined sewing function in real-time.

2. A sewing machine as defined in claim 1, said motor(s) being selected from the group consisting of a stepper motor, a DC brushless motor, an AC servo motor, and a linear motor.

3. A sewing machine as defined in claim 1, each said controller having a USB interface.

4. A sewing machine as defined in claim 1, each said controller having an Ethernet interface.

5. A sewing machine as defined in claim 1, each said controller having an IEEE1394 interface.

6. A sewing machine as defined in claim 1, said network being a serial network.

7. A sewing machine as defined in claim 6, said serial network having a daisy chain structure.

8. A sewing machine as defined in claim 6, said serial network having a multi-drop structure.

9. A sewing machine as defined in claim 6, said serial network having a tree structure.

10. A sewing machine as defined in claim 1, further comprising an on-board controller coupled between said network and said external computer for network protocol message translation.

11. A sewing machine as defined in claim 1, each said controller having a unique identification.

12. A sewing machine as defined in claim 11, said sewing commands including said unique identification.

13. A sewing machine system comprising:

one or more sewing machines each having one or more motors and sensors;

a computer for receiving status messages from said sensors and for generating control messages responsive to said status messages for controlling said motors to perform a predetermined sewing function in real-time: and, a high speed network coupling said computer and said motors and sensors for directly communicating said control and status messages.

14. A sewing machine system as defined by claim 13, each said motor having a dedicated controller.

15. A sewing machine system as defined by claim 14, said dedicated controller being an integrated controller.

16. A sewing machine controlled by an external computer for performing a predetermined sewing function, said sewing machine comprising:

one or more motors responsive to sewing control messages from said external computer;

one or more sensors for providing sewing status messages to said external computer; and, a high speed network coupling said motor(s) and sensor(s) to said external computer for directly communicating said control and status messages; said control messages being responsive to said status messages and generated by said external computer to perform said predetermined sewing function in real-time.

17. A sewing machine as defined by claim 16, each said motor having a dedicated controller.

18. A sewing machine as defined by claim 17, said dedicated controller being an integrated controller.

19. A sewing machine as defined in claim 17, each said controller having an interface selected from the group consisting of a USB interface, an Ethernet interface, and an IEEE1394 interface.

20. A sewing machine as defined in claim 17, each said controller having a unique identification.

21. A sewing machine as defined in claim 20, each said controller being responsive to said sewing control messages directed to said unique identification.

22. A sewing machine as defined in claim 16, said motor(s) being selected from the group consisting of a stepper motor, a DC brushless motor, an AC servo motor, and a linear motor.

23. A sewing machine as defined in claim 16, said network being a serial network.

24. A sewing machine as defined in claim 23, said serial network having a structure selected from the group consisting of a daisy chain structure, a multi-drop structure, and a tree structure.

25. A sewing machine as defined in claim 16, further comprising an on-board controller coupled between said network and said external computer for network protocol message translation.

* * * * *